US009772118B1

(12) United States Patent
Wegner et al.

(10) Patent No.: US 9,772,118 B1
(45) Date of Patent: Sep. 26, 2017

(54) HYBRID DIRECT AND INDIRECT FLUID HEATING SYSTEM

(75) Inventors: Mark Wegner, Lennox, SD (US); Brad Hyronimus, Beresford, SD (US); John W. Finger, Beresford, SD (US)

(73) Assignee: Sioux Corporation, Beresford, SD (US)

( * ) Notice: Subject to any disclaimer, the term of this patent is extended or adjusted under 35 U.S.C. 154(b) by 661 days.

(21) Appl. No.: 13/352,881

(22) Filed: Jan. 18, 2012

(51) Int. Cl.
*F24H 1/12* (2006.01)
*F24H 1/10* (2006.01)

(52) U.S. Cl.
CPC ..... *F24H 1/12* (2013.01); *F24H 1/10* (2013.01)

(58) Field of Classification Search
USPC ..... 122/18.2, 18.4, 193–195, 51, 136 R
See application file for complete search history.

(56) References Cited

U.S. PATENT DOCUMENTS 2,674,981 A * 4/1954 Clarkson ..... 122/136 R
2,987,061 A * 6/1961 Huber ..... F24H 1/107 126/359.1
3,903,868 A * 9/1975 Salvo ..... 122/18.31
4,543,943 A * 10/1985 Gruber et al. ..... 122/18.1
4,596,235 A 6/1986 Bougard
4,641,606 A 2/1987 Roberts
4,753,220 A * 6/1988 Lutzen ..... F24H 1/107 122/20 A
4,920,925 A * 5/1990 Korenberg et al. ..... 122/149
5,154,599 A * 10/1992 Wunning ..... 431/215
5,168,861 A * 12/1992 Lutzen ..... F24H 1/107 126/355.1
5,305,735 A * 4/1994 Welden ..... F24H 1/107 122/31.1
5,555,850 A * 9/1996 Garcia ..... 122/248
5,713,310 A * 2/1998 Lemke ..... B08B 3/026 122/18.4
5,924,391 A 7/1999 Baker
6,085,701 A * 7/2000 Stauffer et al. ..... 122/367.1
6,223,698 B1 * 5/2001 Lacaze ..... F24H 1/107 122/18.3
6,435,174 B1 * 8/2002 Spilde et al. ..... 126/378.1
6,564,755 B1 5/2003 Whelan
6,776,153 B1 * 8/2004 Walker et al. ..... 126/355.1
6,981,651 B2 1/2006 Robertson
7,438,024 B2 10/2008 Bast
7,891,324 B2 * 2/2011 Franklin et al. ..... 122/31.1
8,490,582 B1 * 7/2013 Wingen ..... F22B 1/1807 122/406.1

(Continued)

*Primary Examiner* — Nathaniel Herzfeld
(74) *Attorney, Agent, or Firm* — Jeffrey A. Proehl; Woods, Fuller, Shultz & Smith, P.C.

(57) ABSTRACT

A fluid heater for heating fluid moving along a fluid path between a fluid inlet and a fluid outlet. The fluid heater comprises a fluid preheating assembly configured to directly heat fluid moving along the fluid path, a fluid holding tank for receiving preheated fluid moving along the fluid path from the fluid preheating assembly, a primary fluid pump configured to pump fluid along the fluid path, and a primary fluid heating assembly configured to indirectly heat fluid moving along the fluid path from the fluid holding tank. Fuel is combusted in the primary fluid assembly and an exhaust gas movement path is defined to guide the exhaust gas from the primary fluid heating assembly through the fluid holding tank to the fluid preheating assembly.

20 Claims, 2 Drawing Sheets

(56) References Cited

U.S. PATENT DOCUMENTS

| | | | |
|---|---|---|---|
| 2004/0206485 | A1 | 10/2004 | Ferraro |
| 2007/0199688 | A1 | 8/2007 | Okonski |
| 2008/0014537 | A1 | 1/2008 | Atreya |
| 2010/0186926 | A1 | 7/2010 | Varlaro |
| 2010/0251975 | A1 | 10/2010 | Mattison |
| 2011/0114300 | A1 | 5/2011 | Kim |

* cited by examiner

HYBRID DIRECT AND INDIRECT FLUID HEATING SYSTEM

BACKGROUND

Field

The present disclosure relates to fluid heaters and more particularly pertains to a new hybrid direct and indirect fluid heating system for heating fluid with higher efficiency at higher outlet temperatures than other fluid heating systems.

SUMMARY

In one aspect, the present disclosure relates to a fluid heater for heating fluid moving along a fluid path between a fluid inlet and a fluid outlet. The fluid heater may comprise a fluid preheating assembly configured to directly heat fluid moving along the fluid path, a fluid holding tank for receiving preheated fluid moving along the fluid path from the fluid preheating assembly, a primary fluid pump configured to pump fluid along the fluid path, and a primary fluid heating assembly configured to indirectly heat fluid moving along the fluid path from the fluid holding tank. The fuel may be combusted in the primary fluid assembly and an exhaust gas movement path is defined to guide the exhaust gas from the primary fluid heating assembly through the fluid holding tank to the fluid preheating assembly.

In another aspect, the disclosure relates to a fluid heater for heating fluid moving along a fluid path between a fluid inlet and a fluid outlet. The fluid heater may comprise a fluid preheating assembly configured to directly heat fluid moving along the fluid path, a fluid holding tank for receiving preheated fluid moving along the fluid path from the fluid preheating assembly, a primary fluid pump configured to pump fluid along the fluid path, and a primary fluid heating assembly configured to indirectly heat fluid moving along the fluid path from the fluid holding tank. The fuel may be combusted in the primary fluid assembly and an exhaust gas movement path is defined to guide the exhaust gas from the primary fluid heating assembly through the fluid holding tank to the fluid preheating assembly. A direction of movement of fluid along the fluid path in the fluid preheating assembly, fluid holding tank and primary fluid heating assembly may be substantially opposite to a direction of movement of exhaust gases on the exhaust gas movement path moving through the fluid preheating assembly, fluid holding tank and primary fluid heating assembly.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
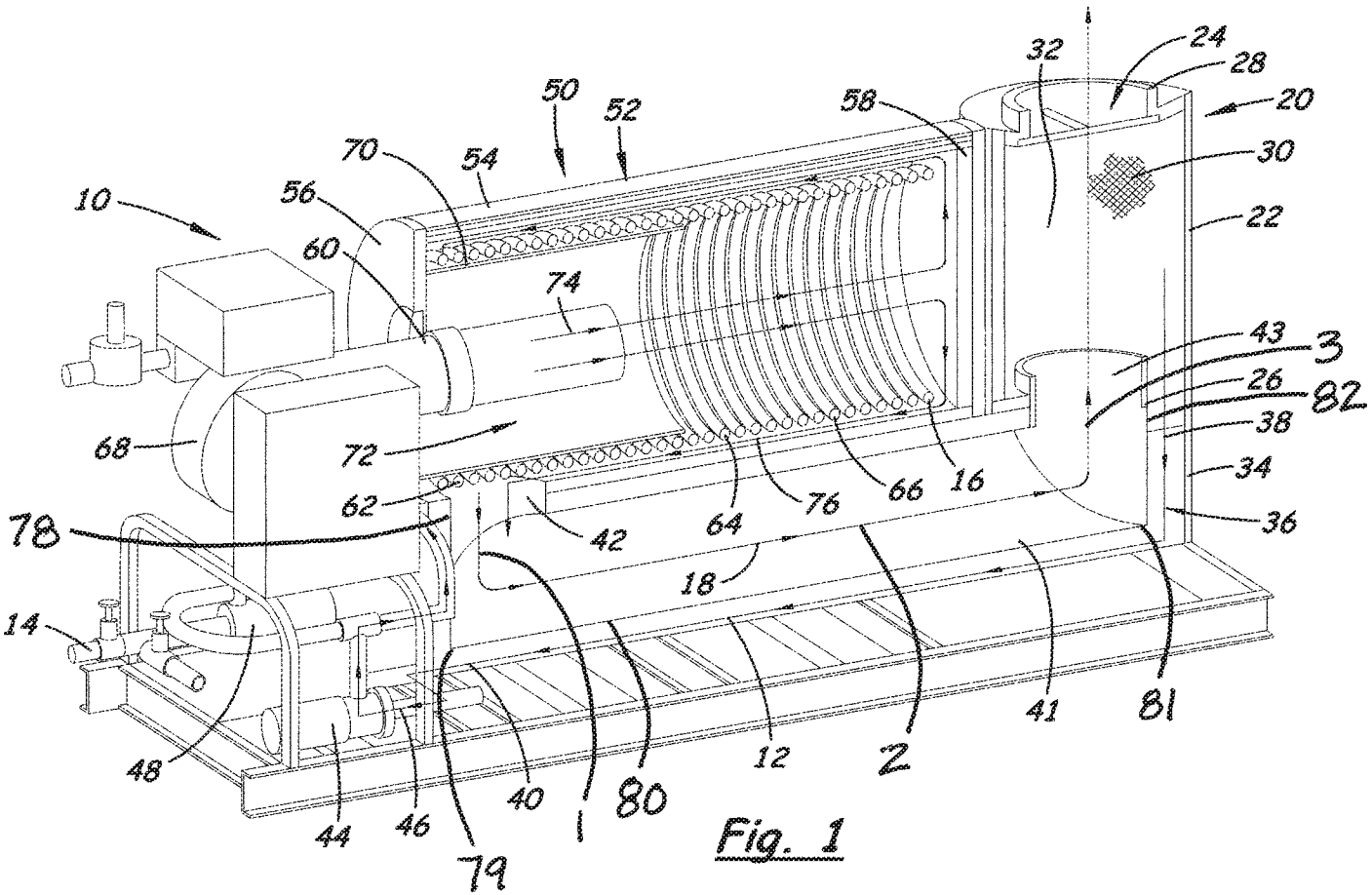
FIG. 1 is a schematic perspective sectional view of a new hybrid direct and indirect fluid heating system according to the present disclosure.
Figure 2:
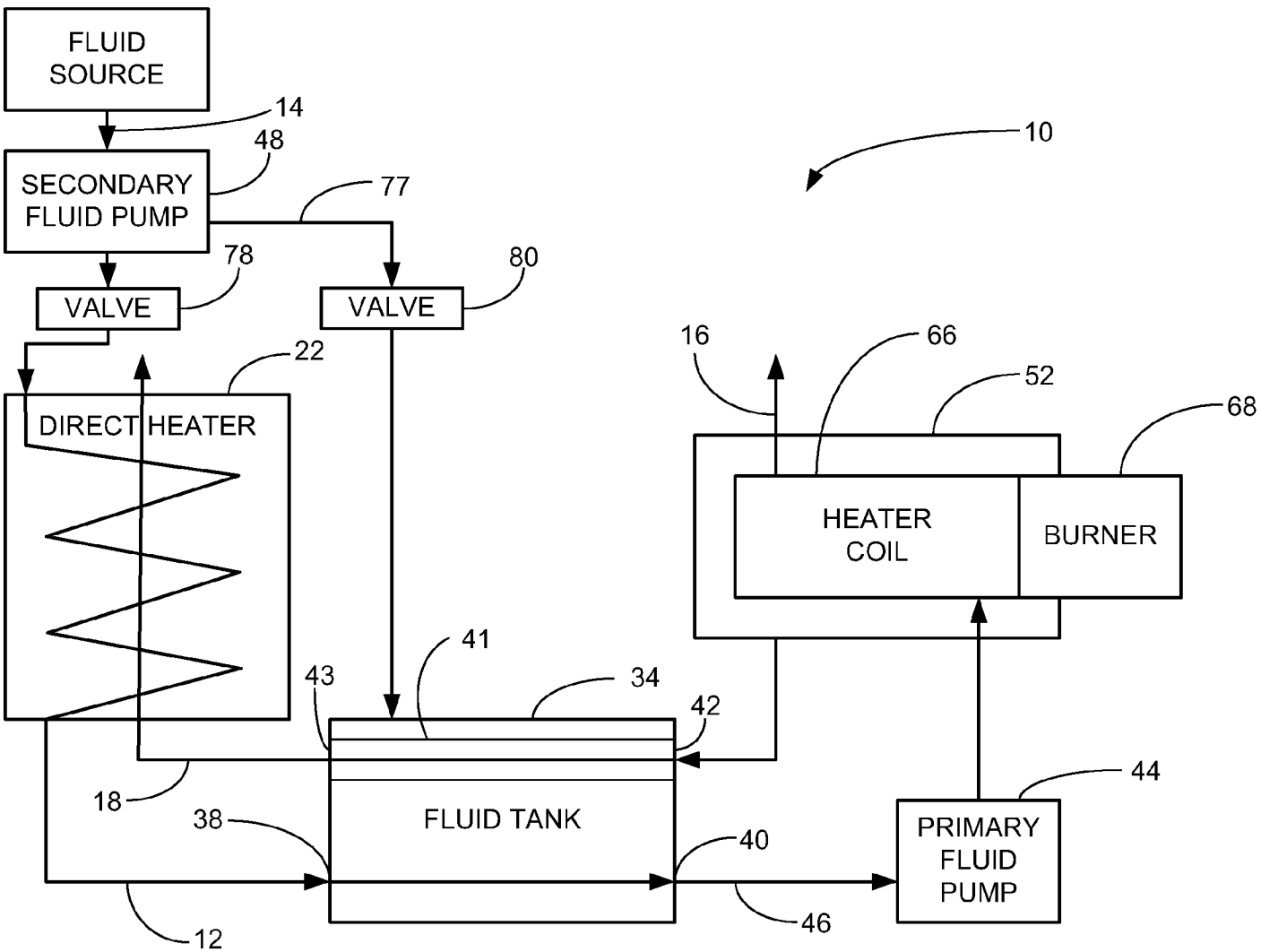
FIG. 2 is a schematic view of the system, according to an illustrative embodiment.

With reference now to the drawings, and in particular to FIGS. 1 and 2 thereof, a new hybrid direct and indirect fluid heating system embodying the principles and concepts of the disclosed subject matter will be described.

The disclosure relates to a fluid heating system 10 for heating fluid, which in many implementations will be water, but the usefulness of the system is not necessarily limited to heating water. In some of the most preferred embodiments of the system 10, a combination of direct heating of the fluid and indirect heating of the fluid is utilized to maximize the efficiency of the heating based upon the inputs to the system, such as fuel, electricity, water and air. The applicants have recognized that direct heating of the fluid alone may result in droplets of the fluid being heated non-uniformly, and some droplets may be heated to the point to flashing over to steam, and then moving with the combustion gases out of the flue rather than remaining in the fluid stream. The steam in the flue gases thus does not contribute to the heating of the fluid dispensable from the system, and the energy expended to heat the fluid that escapes is wasted.

The applicants have thus devised a system that utilizes direct heating of the fluid as an initial preheating of the fluid in which the fluid is directly heated from an initial temperature (such as the temperature of the fluid source) to an intermediate temperature which is below the temperature at which the fluid might flash over to a gaseous form. The fluid is then indirectly heated from the intermediate temperature to a final temperature in a manner that is less likely to result in lost energy such as through flashing to a gaseous state. The system 10 of the disclosure is highly suitable, as an example, for systems in which a large volume of fluid is sought to be heated.

The system 10 defines a fluid path 12 that extends between a fluid inlet 14 and a fluid outlet 16. Fluid entering the system at the fluid inlet 14 is at a source or inlet temperature, and the temperature at the fluid outlet 16 is at an outlet temperature. An exhaust gas movement path 18 may also be defined by the system 10 from movement of the gases resulting from combustion of a fuel.

In the illustrative embodiments described herein, the fluid heater system 10 may include a fluid preheating assembly 20 that is generally configured to directly heat fluid moving along the fluid path 12, and the fluid preheating assembly may be located on the fluid path toward the fluid inlet 14. In some implementations, the fluid preheating assembly 20 is the initial stage of heating acting on the fluid moving along the fluid path.

The fluid preheating assembly 20 may include a housing 22 that defines a housing interior 24, and generally defines a portion of the exhaust gas movement path 18 through the interior 24. The housing 22 may have a lower opening 26 and an upper opening 28 with the exhaust gas movement path 18 extending between the openings. The portion of the exhaust gas movement path 18 defined by the housing 22 may be substantially vertically oriented. The housing interior 24 also may form a portion of the fluid path 12, with the fluid path extending through the lower opening. In some embodiments, the housing 22 is formed by a substantially cylindrical wall having a central axis that extends in a substantially vertical direction, and the wall may be insulated so that heat is not readily transferred from an interior surface of the wall to the exterior surface of the wall.

The fluid preheating assembly 20 may also include transfer media 30 positioned in the housing interior 24, and may fill or occupy at least a portion of the housing interior, and in some embodiments may fill substantially the entirety of the interior 24. The transfer media 30 may be gas permeable to permit exhaust gases moving along the exhaust gas movement path 18 to move through the media. The movement path 18 may thus pass through the media, and the media is heated by the exhaust gases passing therethrough. The movement of fluid along the fluid path 12 in the housing interior 24 is in a substantially opposite direction of the movement of exhaust gases on the exhaust gas movement path 18. In the illustrative embodiments, the transfer media 30 has a reticulated form, and may be formed of a metal such as, for example, a suitable stainless steel.

The fluid preheating assembly 20 may further include a fluid dispersion device 32 that may be generally configured to disperse fluid from the fluid path 12 onto the transfer media 30. The fluid dispersion device 32 may receive fluid from the fluid path 12 at a temperature that is substantially equal to the inlet temperature, and upon being dispersed onto the transfer media 30, the fluid may be heated by the media which has in turn been heated by the exhaust gases. The dispersed fluid may also be heated by direct contact with the exhaust gases passing through the housing interior 24 and the media 30. The fluid dispersion device 32 may be positioned toward the upper opening 28 of the housing 22 to disperse fluid downwardly onto the transfer media. In some of the illustrative embodiments, the fluid dispersion device 32 may comprise a fluid sprayer with a manifold and individual nozzles positioned to spray the fluid onto the transfer media. The fluid sprayer may be positioned above the transfer media to spray downwardly onto the transfer media. The transfer media 30 may be positioned above, or at least at a higher vertical level than, the lower opening 26 of the housing 22 such that fluid sprayed downwardly onto the media then drips and drains from the media 30 moves through the lower opening 26.

The system 10 may further comprise a fluid holding tank 34 that forms a portion of the fluid path 12 and may be configured to receive preheated fluid from the fluid preheating assembly 20. The fluid holding tank 34 has a tank interior 36 configured to receive the fluid. The tank interior 36 may define a portion of the fluid path 12, and the tank has a tank fluid inlet 38 and a tank fluid outlet 40 to permit fluid to move into and out of the tank interior. The tank fluid inlet 38 may be in communication with the lower opening 26 of the housing 22 such that fluid draining from the transfer media moves through the lower opening of the housing into the tank interior 36 through the tank fluid inlet 38, generally under the influence of gravity on the fluid and not by any active means causing the fluid movement.

The tank fluid outlet 40 may be located at a spaced location from the tank fluid inlet 38 to cause a degree of flow movement between the inlet 38 and the outlet 40, although the movement of fluid along this portion of the path 12 may not be rapid due to the volume of fluid collected in the tank interior. The tank fluid outlet 40 may be located toward an opposite end of the elongated tank from the end having the tank fluid inlet 38, so that the path 12 extends along a large portion of the length of the tank.

The exhaust gas movement path 18 may extend through the tank interior 36. In some embodiments, an exhaust gas conduit 41 may be configured to guide exhaust gas through the fluid holding tank 34 such that the exhaust gas movement path 18 extends through the exhaust gas conduit. The exhaust gas conduit 41 may be positioned in the tank interior 36 such that the conduit is contacted by fluid in the tank interior to contribute to indirect heating of the fluid in the tank by the exhaust gases passing through, and heating the wall of, the conduit. The exhaust gas conduit 41 may have an entry 42 positioned adjacent to an exhaust opening 62 of the primary heating assembly 50 where the exhaust gas path movement path enters the exhaust gas conduit as shown in FIGS. 1 and 2. The exhaust gas conduit 41 may also have an exit 43 positioned adjacent to the tank fluid inlet 38 where the exhaust gas path movement path exits the exhaust gas conduit as shown in FIGS. 1 and 2. The gas entry 42 of the conduit 41 may be positioned at or toward one end of the tank 34 and the gas exit 43 may be located at or toward an opposite end of the tank 34, which may be located close to the tank fluid inlet 38, to create a gas flow between the entry 42 and the exit 43 as a part of the movement path 18. The exhaust entry 42 may be proximate to the tank fluid outlet 40 at one end of the tank, but in many embodiments the gas entry 42 will have a location on the tank that is toward the top of the tank, while the fluid outlet 40 may be located toward the bottom of the tank. Movement of fluid along the fluid path 12 in the tank interior 36 may thus be in a substantially opposite direction of the movement of exhaust gases on the exhaust gas movement path 18 in the exhaust gas conduit.

As illustratively shown in FIG. 1 of the drawings, the exhaust gas conduit 41 may define a closed path between the entry 42 and exit 43 of the conduit that isolates the exhaust gases on the exhaust gas movement path from direct contact with the fluid on the fluid path in the interior 36 of the fluid holding tank 34. The exhaust gas conduit 41 may have a first portion 78 with a length extending from the entry 42 of the conduit 41 to a first elbow 79 of the conduit, a second portion 80 with a length extending from the first elbow 79 of the conduit to a second elbow 81 of the conduit, and a third portion 82 with a length extending from the second elbow 81 to the exit 43 of the conduit. As also illustratively shown in FIG. 1, the first portion 78 of the exhaust gas conduit 41 may be vertically oriented such that a first portion 1 of the exhaust gas movement path in the first portion 78 of the conduit 41 extends downwardly into the interior of the fluid holding tank. The second portion 80 of the exhaust gas conduit may be substantially horizontally oriented (see FIG. 1) such that a second portion 2 of the exhaust gas movement path in the conduit 41 extends substantially horizontally through the interior of the fluid holding tank to the fluid preheating assembly. The third portion 82 of the exhaust gas conduit 41 may be substantially vertically oriented (see FIG. 1) such that a third portion 3 of the exhaust gas movement path extends upwardly out of the interior 36 of the fluid holding tank 34.

As illustratively shown in FIG. 1 of the drawings, the substantially horizontal second portion 80 of the exhaust gas conduit 41 may be oriented in the interior 36 of the holding tank such that the exhaust gas has a movement direction through the interior 36 that is parallel and opposite of the fluid movement direction in the tank. The length of the first portion 1 of the exhaust gas conduit may define a first portion of the exhaust gas movement path with a first length, the length of the second portion 2 of the exhaust gas conduit 41 may define a second portion of the exhaust gas movement path with a second length, and the length of the third portion of the exhaust gas conduit may define a third portion of the exhaust gas movement path with a third length. As illustratively shown in FIG. 1, the length of the second portion of the exhaust gas conduit may be greater than the length of the first portion of the exhaust gas conduit and the length of the third portion of the exhaust gas conduit defining a third portion of the exhaust gas movement path.

The system 10 may also include a primary fluid pump 44 that may generally be configured to pump fluid to actively move the fluid along the fluid path 12. The primary fluid pump 44 may be in fluid communication with the fluid path 12, and may be connected to the tank fluid outlet 40 to draw fluid from the tank interior 36, and may tend to create movement of fluid in the tank between the fluid inlet 38 and the fluid outlet 40. The primary fluid pump 44 may be connected to the tank fluid outlet 40 by a conduit 46.

The system 10 may also include a secondary fluid pump 48 that may also be configured to pump fluid along the fluid path. More specifically, the secondary fluid pump 48 may be configured to pump fluid into the fluid preheating assembly 20, and may be positioned between the fluid inlet 14 and the fluid preheating assembly 20 in the fluid path, The system 10 may further include a primary fluid heating assembly 50 that is generally configured to indirectly heat fluid moving along the fluid path 12, and may be the portion of the fluid path where the greatest degree of fluid heating occurs. The primary fluid heating assembly 50 may comprise a heater housing 52 which may include a perimeter wall 54 that may be generally cylindrical in shape, and may have insulated characteristics. In some of the most preferred embodiments, the heater housing may be elongated with a burner end 56 and a reversing end 58 opposite of the burner end. The heater housing 52 may also have an intake opening 60 and an exhaust opening 62 through which the exhaust gas movement path 18 extends.

The primary fluid heating assembly 50 may also include fluid tubing 64 that is positioned in the interior of the perimeter wall of the heater housing, and defines a portion of the fluid path 12. The fluid tubing 64 may be connected to the fluid pump 44 to receive fluid pumped along the fluid path. In some of the most preferred embodiments, the fluid tubing 64 may be formed into a coil 66 which may be oriented to extend about a central axis that generally extends between the burner end 56 and the reversing end 58 of the heater housing. The coil may be positioned adjacent to a portion of the exhaust gas movement path 18 such that the exhaust gases pass over the exterior surfaces of the tubing. In some embodiments, a portion of the exhaust gas movement path 18 may extend through the center area of the coil 66 and a portion of the exhaust gas movement path 18 extends about an exterior of the coil. The fluid tubing 64 is connected to and terminates with the fluid outlet 16 of the system 10.

The primary fluid heating assembly 50 may comprise a burner 68 configured to combust or burn fuel to generate hot combustion exhaust gases to move along the exhaust gas movement path 18. The burner 68 may be configured to direct the combustion exhaust gases through the intake opening 60 of the heater housing, and may be configured to direct the combustion exhaust gas about the fluid tubing 64, such as into and through the center of the coil 66 of fluid tubing. The burner may burn, for example, liquefied petroleum (LP), natural gas (NG), diesel fuel or any other suitable fuel. A heat shield 70 may be utilized to define a combustion chamber 72 which may be positioned in the center of the coil 66. The heat shield 70 may be configured to receive the combustion exhaust gas from the burner 68, and may generally extend from a location adjacent the intake opening 60 at the burner end of the housing toward the reversing end 58.

The primary fluid heating assembly 50 is preferably although not necessarily configured so that the exhaust gas movement path 18 has a first pass that extends through the center of the coil and a second pass extending about the coil, such that the exhaust gas movement path turns and reverses at the reversing end of the housing.

Optionally, the system 10 may be configured to provide the capability to bypass the fluid preheating assembly 20, which may be useful in situations where the system is used to heat and maintain the heated temperature of the fluid held in another tank, and thus operates to recirculate the fluid between the system 10 and the other tank to maintain the temperature in the other tank. Illustratively, if it is detected that the temperature of the fluid at the fluid inlet 14 is higher than a predetermined temperature, such as, for example, a temperature that may fall in the range of approximately 140 F. degrees to approximately 180 degrees F., the preheating assembly 20 is bypassed to help avoid flashing of the fluid to a vapor in the assembly 20.

When bypass of the preheating assembly 20 is desired, then a bypass line 77 may be utilized by closing the primary inlet valve 78 and opening the bypass valve 80 so that the fluid path is diverted from the preheating assembly, and may be directed to the fluid holding tank 34 either through direct connection or connection to a conduit in communication with the tank 34. When it is detected that the temperature of the fluid at the inlet falls below the predetermined temperature, then the preheating assembly may again be utilized by, for example, closing the bypass valve 80 and opening the primary inlet valve 78 to resume typical operation of the system.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A fluid heater for heating fluid moving along a fluid path between a fluid inlet and a fluid outlet, the fluid heater comprising:

a fluid preheating assembly configured to directly heat fluid moving along the fluid path;

a fluid holding tank for receiving preheated fluid moving along a portion of the fluid path from the fluid preheating assembly, the fluid holding tank having an interior configured to guide fluid on the portion of the fluid path through the holding tank in a horizontal fluid movement direction;

a primary fluid pump configured to pump fluid along the fluid path; and a primary fluid heating assembly configured to indirectly heat fluid moving along the fluid path from the fluid holding tank by fuel combusted in the primary fluid heating assembly;

an exhaust gas conduit defining an exhaust gas movement path from the primary fluid heating assembly to the fluid preheating assembly through the fluid holding tank, the exhaust gas conduit having an entry where the exhaust gas movement path enters the exhaust gas conduit and an exit where the exhaust gas movement path exits the exhaust gas conduit;

a first portion of the exhaust gas conduit having a length extending from the entry of the conduit to a first elbow of the conduit and defining a first portion of the exhaust gas movement path, a second portion of the exhaust gas conduit having a length extending from the first elbow of the conduit to a second elbow of the conduit and defining a second portion of the exhaust gas movement path, a third portion of the exhaust gas conduit having a length extending from the second elbow to the exit of the conduit and defining a third portion of the exhaust gas movement path;

wherein the first portion of the exhaust gas conduit is vertically oriented such that the first portion of the exhaust gas movement path extends downwardly into the interior of the fluid holding tank, the second portion of the exhaust gas conduit is substantially horizontally oriented such that the second portion of the exhaust gas movement path extends horizontally through the interior of the fluid holding tank to the fluid preheating assembly; and wherein the second portion of the exhaust gas conduit is oriented in the interior of the holding tank such that the exhaust gas has a movement direction through the interior that is parallel and opposite of a movement direction of the fluid;

wherein the length of the second portion of the exhaust gas conduit is greater than the length of the first portion of the exhaust gas conduit and is greater than the length of the third portion of the exhaust gas conduit.

2. The fluid heater of claim 1 wherein the fluid preheating assembly comprises a housing with a housing interior defining a portion of the exhaust gas movement path, transfer media positioned in the housing interior through which the exhaust gas movement path passes, and a fluid dispersion device configured to disperse fluid from the fluid path onto the transfer media.

3. The fluid heater of claim 2 wherein the housing has a lower opening and an upper opening with the exhaust gas movement path extending therebetween in a substantially vertical orientation.

4. The fluid heater of claim 1 wherein the fluid holding tank is elongated between longitudinal ends, and the exhaust gas conduit extends in a longitudinal direction of the tank and enters the tank interior toward one end of the tank and exits the tank interior at an opposite end of the tank.

5. The fluid heater of claim 2 wherein a portion of the fluid path passes through the housing interior, and movement of fluid along the fluid path in the housing interior is in a downward vertical direction that is opposite of an upward vertical direction of movement of exhaust gases on the exhaust gas movement path in the housing interior.

6. The fluid heater of claim 1 wherein the primary fluid heating assembly comprises a heater housing, fluid tubing positioned about a combustion chamber and defining a portion of the fluid path, and a burner configured to combust a fuel to generate combustion exhaust gases to move along the exhaust gas movement path.

7. The fluid heater of claim 6 wherein the fluid tubing is formed into a coil.

8. The fluid heater of claim 7 wherein the primary fluid heating assembly is configured such that the exhaust gas movement path has a first horizontal pass that extends inside the coil and a second horizontal pass extending outside the coil.

9. The fluid heater of claim 7 additionally comprising a heat shield positioned in the coil of fluid tubing to define the combustion chamber.

10. The fluid heater of claim 1 wherein the exhaust gas conduit is positioned in the tank interior such that an exterior of the conduit is contacted by fluid in the tank interior moving along the fluid path.

11. The fluid heater of claim 1 wherein a direction of movement of fluid along the fluid path in the fluid preheating assembly, fluid holding tank and primary fluid heating assembly is substantially opposite to a direction of movement of exhaust gases on the exhaust gas movement path moving through the fluid preheating assembly, fluid holding tank and primary fluid heating assembly.

12. The fluid heater of claim 1 wherein the primary fluid pump is connected to a tank outlet to draw fluid from an interior of the fluid tank and pump fluid through the primary fluid heating assembly.

13. The fluid heater of claim 1 additionally comprising a secondary fluid pump configured to pump fluid along the fluid path, the secondary fluid pump being configured to pump fluid into the fluid preheating assembly.

14. The fluid heater of claim 1 wherein the exhaust gas conduit is configured such that the length of the second portion of the exhaust gas conduit is at least four times the length of the third portion of the exhaust gas conduit.

15. The fluid heater of claim 1 wherein the exhaust gas conduit is configured such that the length of the second portion of the exhaust gas conduit is approximately four times the length of the third portion of the exhaust gas conduit.

16. The fluid heater of claim 1 wherein the exhaust gas conduit is configured such that the length of the second portion of the exhaust gas conduit is at least four times the length of the third portion of the exhaust gas conduit and the length of the second portion of the exhaust gas conduit is approximately four times the length of the third portion of the exhaust gas conduit.

17. The fluid heater of claim 1 wherein the exhaust gas conduit defines a closed path between the entry and exit to isolate the exhaust gases on the exhaust gas movement path from direct contact with the fluid on the fluid path.

18. The fluid heater of claim 1 wherein the third portion is substantially vertically oriented such that the third portion of the exhaust gas movement path extends upwardly out of the interior of the fluid holding tank.

19. A fluid heater for heating fluid moving along a fluid path between a fluid inlet and a fluid outlet, the fluid heater comprising:

a fluid preheating assembly configured to directly heat fluid moving along the fluid path;

a fluid holding tank for receiving preheated fluid moving along a portion of the fluid path from the fluid preheating assembly, the fluid holding tank having an interior configured to guide fluid on the portion of the fluid path through the holding tank in a horizontal fluid movement direction;

a primary fluid pump configured to pump fluid along the fluid path; and a primary fluid heating assembly configured to indirectly heat fluid moving along the fluid path from the fluid holding tank by fuel combusted in the primary fluid heating assembly;

an exhaust gas conduit defining an exhaust gas movement path from the primary fluid heating assembly to the fluid preheating assembly through the fluid holding tank, the exhaust gas conduit having an entry where the exhaust gas movement path enters the exhaust gas conduit and an exit where the exhaust gas movement path exits the exhaust gas conduit, the exhaust gas conduit defining a closed path between the entry and exit to isolate the exhaust gases on the exhaust gas movement path from direct contact with the fluid on the fluid path;

a first portion of the exhaust gas conduit having a length extending from the entry of the conduit to a first elbow of the conduit and defining a first portion of the exhaust gas movement path, a second portion of the exhaust gas conduit having a length extending from the first elbow of the conduit to a second elbow of the conduit and defining a second portion of the exhaust gas movement path, a third portion of the exhaust gas conduit having a length extending from the second elbow to the exit of the conduit and defining a third portion of the exhaust gas movement path;

wherein the first portion of the exhaust gas conduit is vertically oriented such that the first portion of the exhaust gas movement path extends downwardly into the interior of the fluid holding tank, the second portion of the exhaust gas conduit is substantially horizontally oriented such that the second portion of the exhaust gas movement path extends horizontally through the interior of the fluid holding tank to the fluid preheating assembly, and the third portion is substantially vertically oriented such that the third portion of the exhaust gas movement path extends upwardly out of the interior of the fluid holding tank; and wherein the second portion of the exhaust gas conduit is oriented in the interior of the holding tank such that the exhaust gas has a movement direction through the interior that is parallel and opposite of a movement direction of the fluid;

wherein the length of the second portion of the exhaust gas conduit is greater than the length of the first portion of the exhaust gas conduit and is greater than the length of the third portion of the exhaust gas conduit.

20. A fluid heater for heating fluid moving along a fluid path between a fluid inlet and a fluid outlet, the fluid heater comprising:

a fluid preheating assembly configured to heat fluid moving along a portion of the fluid path by direct contact with exhaust gases moving along the exhaust gas movement path, the fluid preheating assembly having a housing with an interior receiving exhaust gases on the exhaust gas movement path;

a fluid holding tank for receiving preheated fluid moving along a portion of the fluid path from the fluid preheating assembly, the fluid holding tank being elongated between opposite ends and having an interior configured to guide fluid on the portion of the fluid path through the holding tank in a first horizontal fluid movement direction;

a primary fluid pump configured to pump fluid along the fluid path; and a primary fluid heating assembly configured to indirectly heat fluid moving in a tubular coil forming a portion of the fluid path by fuel combusted by a burner of the primary fluid heating assembly to create a flow of exhaust gas along an exhaust gas movement path, the primary fluid heating assembly including a housing with an interior from which the exhaust gases on the exhaust gas movement path exits after passing over the coil;

an exhaust gas conduit defining an exhaust gas movement path from the primary fluid heating assembly to the fluid preheating assembly through the fluid holding tank, the exhaust gas conduit having an entry where the exhaust gas movement path enters the exhaust gas conduit and an exit where the exhaust gas movement path exits the exhaust gas conduit, the exhaust gas conduit defining a closed path between the entry and exit to isolate the exhaust gases on the exhaust gas movement path from direct contact with the fluid on the fluid path;

a first portion of the exhaust gas conduit having a length extending from the entry of the conduit to a first elbow of the conduit and defining a first portion of the exhaust gas movement path, a second portion of the exhaust gas conduit having a length extending from the first elbow of the conduit to a second elbow of the conduit and defining a second portion of the exhaust gas movement path, a third portion of the exhaust gas conduit having a length extending from the second elbow to the exit of the conduit and defining a third portion of the exhaust gas movement path;

wherein the first portion of the exhaust gas conduit is vertically oriented such that the first portion of the exhaust gas movement path extends downwardly into the interior of the fluid holding tank, the second portion of the exhaust gas conduit is substantially horizontally oriented such that the second portion of the exhaust gas movement path extends horizontally through the interior of the fluid holding tank to the fluid preheating assembly, and the third portion is substantially vertically oriented such that the third portion of the exhaust gas movement path extends upwardly out of the interior of the fluid holding tank; and wherein the second portion of the exhaust gas conduit is oriented in the interior of the holding tank such that the exhaust gas has a horizontal movement direction through the interior that is parallel and opposite of the first horizontal movement direction of the fluid;

wherein the length of the second portion of the exhaust gas conduit is greater than the length of the first portion of the exhaust gas conduit and is greater than the length of the third portion of the exhaust gas conduit.

* * * * *